US006233789B1

(12) United States Patent
Douglas

(10) Patent No.: US 6,233,789 B1
(45) Date of Patent: May 22, 2001

(54) SQUARE TOOL WITH TAPE MEASURE

(76) Inventor: Dennis Douglas, 687 S. Jefferson St., #B, Napa, CA (US) 94559

( * ) Notice: Subject to any disclaimer, the term of this patent is extended or adjusted under 35 U.S.C. 154(b) by 0 days.

(21) Appl. No.: 09/563,397

(22) Filed: May 1, 2000

Related U.S. Application Data

(62) Division of application No. 09/054,224, filed on Apr. 2, 1998, now abandoned.

(51) Int. Cl.[7] ..... A44B 21/00

(52) U.S. Cl. ..... 24/3.12; 224/269; 224/272; 224/668

(58) Field of Search ..... 224/668, 269, 224/272; 24/3.11, 3.12; 33/768, 769, 770

(56) References Cited

U.S. PATENT DOCUMENTS 1,720,471 * 7/1929 Fritsch .
2,583,142 * 1/1952 Frentzel .
3,101,075 * 8/1963 Johmann .
3,882,572 * 5/1975 Hocq .
4,111,343 * 9/1978 Selinko .
4,584,250 * 4/1986 Hooke et al. .
4,717,275 * 1/1988 Burkhardt, Jr. .
4,790,678 * 12/1988 Araki .

FOREIGN PATENT DOCUMENTS

4310602 * 5/1994 (DE) .
2213522 * 8/1989 (GB) .

* cited by examiner

*Primary Examiner*—James R. Brittain
(74) *Attorney, Agent, or Firm*—Jack Lo

(57) ABSTRACT

A square tool with tape measure includes a triangular housing with flat opposite sides and three edges forming a right-angled corner and two acute-angled corners. A groove is arranged along an entire length of each of the edges to enable the tool to be easily grasped and lifted. A measuring tape arranged within the housing is retractable flush into one of the corners. The tape is lockable in any extended position with a locking tab recessed into one of the edges. A bubble level is arranged within a window on the housing for indicating the horizontal position. A pencil holder is attached to one of the edges for holding a pencil. A pencil sharpener is provided for sharpening the pencil. A pair of guide rails arranged along opposite sides of one of the edges can be used for aligning the tool with a work piece. The tool may be clipped to a user's clothing with a belt clip attached to a side of the housing. In alternative embodiments, the belt clip is retractable and extendable. The sides of the housing each include a textured surface on which erasable notes can be written with the pencil. The tool may be used for drawing a very large circle by extending the measuring tape, positioning a pencil at the end of the tape, and pivoting it about a nail positioned through a hole in one of the corners and into a work piece.

5 Claims, 5 Drawing Sheets

SQUARE TOOL WITH TAPE MEASURE

CROSS REFERENCE TO RELATED APPLICATIONS

This is a division of application Ser. No. 09/054,224, filed Apr. 2, 1998 now abandoned.

BACKGROUND OF THE INVENTION

1. Field of the Invention

This invention relates generally to square tools for measuring a right-angle, and tape measures for measuring distance.

2. Prior Art

A square tool is a triangular device for measuring a right-angle. It includes a right-angled corner and two acute-angled corners. A tape measure is a device with a roll of flexible measuring tape extendable from a compact housing. My U.S. patent Des. 349,462 shows a tape measure built into a square tool. A bubble level is arranged within a window, and guide rails extend along opposite sides of one edge. In a second embodiment, it includes a slot extending between the sides for holding a pencil. However, the pencil is completely recessed in the deep slot, which makes it difficult to remove. There is no way to lock the tape in an extended position. The edges of the tool are all flat, and due to its triangular shape, it is difficult to pick up when it is lying flat on a supporting surface. The flat edges are also structurally weak, and may distort during the molding process. The sides of the tool cannot be written on because they are glassy smooth. It cannot be used to draw a circle. There is also no way to clip it handily to the clothing of a user. My U.S. patent Des. 332,413 shows a similar square tool with tape measure, but without the bubble level or the pencil holder. In a second embodiment, it includes a groove extending partially along one edge, and a hole in the groove for receiving one end of a pencil. The other edges are flat, so that they may still slip from the hand. It suffers from much of the same disadvantages as the previous device.

OBJECTS OF THE INVENTION

Accordingly, objects of the present square tool with tape measure are:

to measure a right-angle and at least one other angle;
to indicate the horizontal position;
to ensure alignment along at least one edge with a work piece;
to measure distances;
to enable the measuring tape to be locked in any extended position;
to hold a pencil;
to allow easy removal of the pencil;
to sharpen the pencil;
to be easily grasped and lifted when it is lying flat on a supporting surface;
to provide improved structural strength;
to resist distortion during its molding;
to be usable for drawing a very large circle;
to provide a surface for writing erasable notes;
to provide a retractable belt clip so that it can be laid flat on either side on a work surface; and
to be attachable to the clothing of a user.

Further objects of the present invention will become apparent from a consideration of the drawings and ensuing description.

BRIEF SUMMARY OF THE INVENTION

A square tool with tape measure includes a triangular housing with flat opposite sides and three edges forming a right-angled corner and two acute-angled corners. A groove is arranged along an entire length of each of the edges to enable the tool to be easily grasped and lifted. A measuring tape arranged within the housing is retractable flush into one of the corners. The tape is lockable in any extended position with a locking tab recessed into one of the edges. A bubble level is arranged within a window on the housing for indicating the horizontal position. A pencil holder is attached to one of the edges for holding a pencil. A pencil sharpener is provided for sharpening the pencil. A pair of guide rails arranged along opposite sides of one of the edges can be used for aligning the tool with a work piece. The tool may be clipped to a user's clothing with a belt clip attached to a side of the housing. In alternative embodiments, the belt clip is retractable and extendable. The sides of the housing each include a textured surface on which erasable notes can be written with the pencil. The tool may be used for drawing a very large circle by extending the measuring tape, positioning a pencil at the end of the tape, and pivoting it about a nail positioned through a hole in one of the corners and into a work piece.

DRAWING REFERENCE NUMERALS

| | |
|---|---|
| 10. Housing | 11. Side |
| 12. Side | 13. Edge |
| 14. Edge | 15. Edge |
| 16. Right-Angled Corner | 17. Acute-Angled Corner |
| 18. Acute-Angled Corner | 19. Groove |
| 20. Groove | 21. Groove |
| 22. Measuring Tape | 23. Notch |
| 24. Upper Hook | 25. Lower Hook |
| 26. Locking Tab | 27. Slot |
| 28. Guide Rail | 29. Pencil Holder |
| 30. Pencil Sharpener | 31. Door |
| 32. Hole | 33. Belt Clip |
| 34. Textured Surface | 35. Bubble Level |
| 36. Window | 37. Stop |

-continued

| | |
|---|---|
| 38. Pencil Holder | 39. Slot |
| 40. Edge | 41. Housing |
| 42. Belt Clip | 43. Recess |
| 44. Side | 45. Housing |
| 46. Button | 47. Springs |
| 48. Belt Clips | 49. Channel |
| 50. Side | 51. Side |
| 52. Housing | 53. Sliding Member |

DETAILED DESCRIPTION OF THE INVENTION

Figure 1:
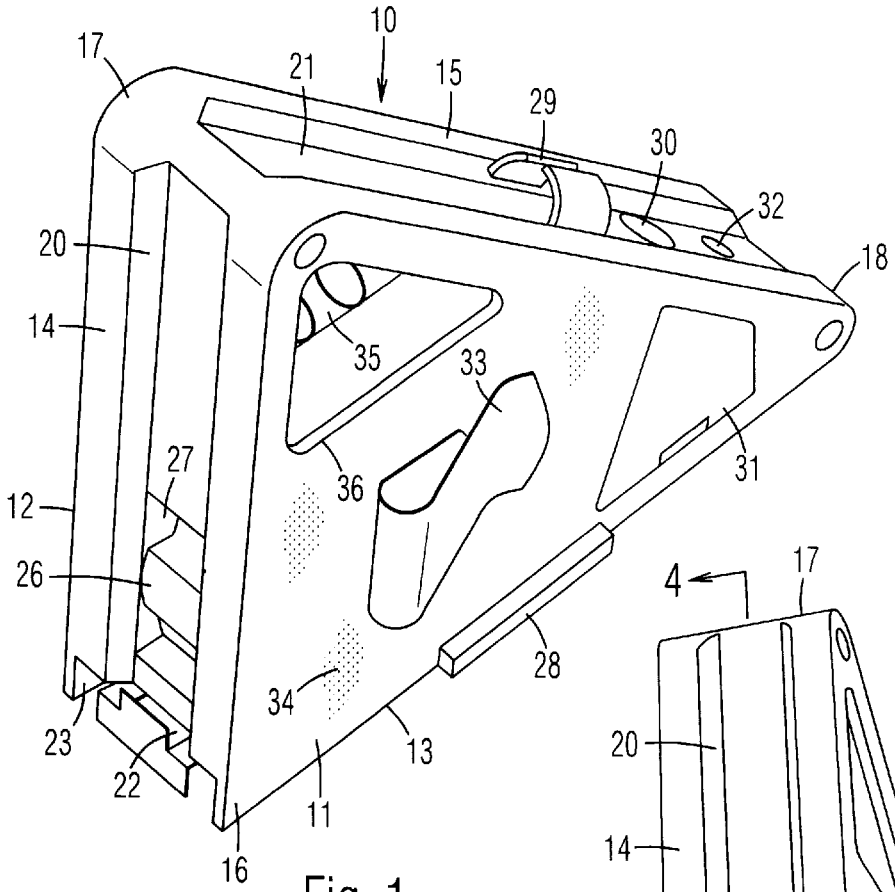
FIG. 1 a top perspective view of a first embodiment of a square tool with tape measure.
Figure 2:
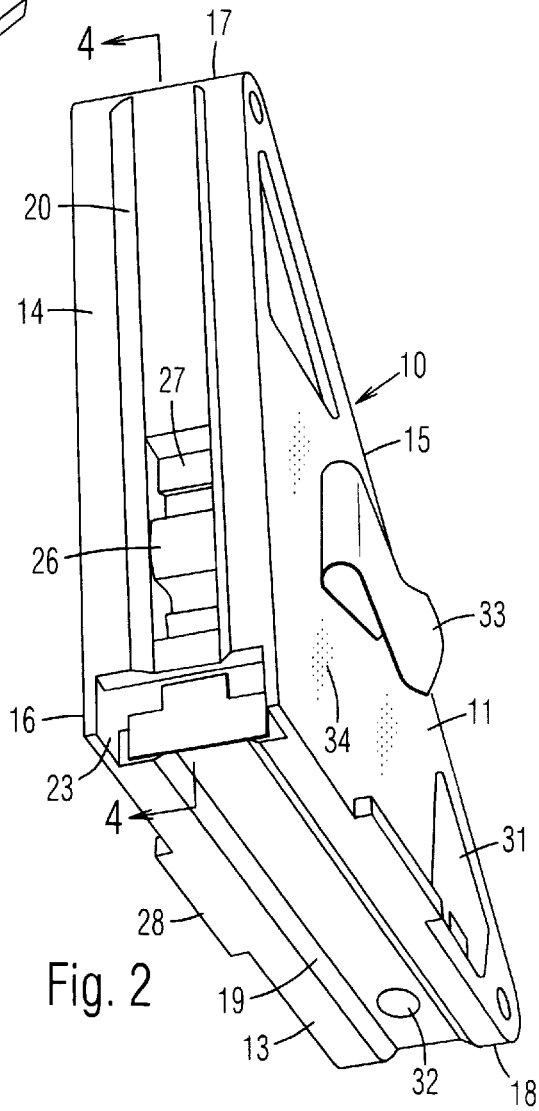
FIG. 2 is a bottom perspective view of the tool.
Figure 4:
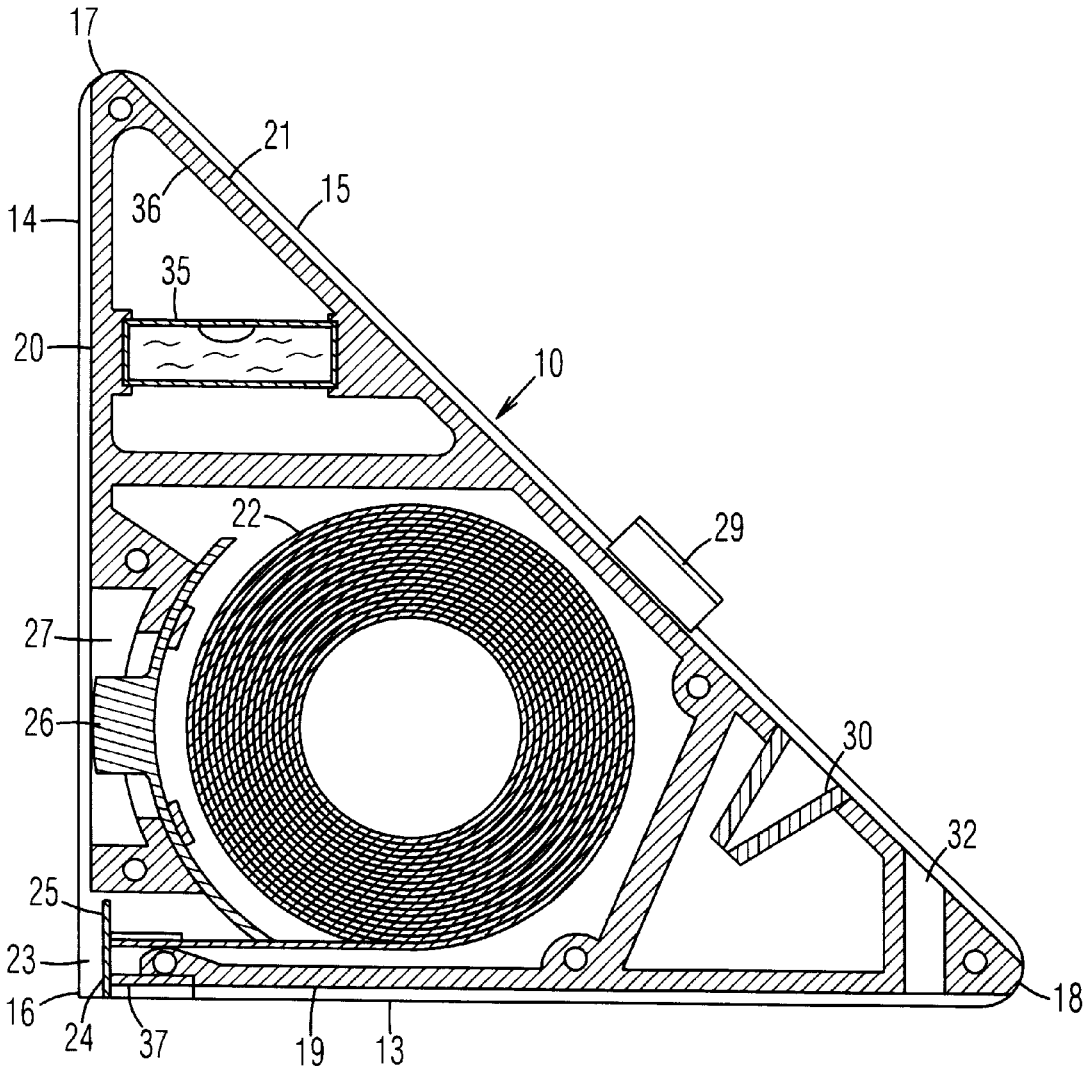
FIG. 4 is a side sectional view of the tool, taken along line 4—4 in FIG. 2.

A first embodiment of the present square tool with tape measure is shown in the top perspective view in FIG. 1, the bottom perspective view in FIG. 2, and the side sectional view in FIG. 4. It includes a triangular housing 10 with opposite sides 11 and 12, and straight edges 13–15 forming a right-angled corner 16 for measuring a right angle, and acute-angled corners 17 and 18 for measuring acute angles. Grooves 19–21 extending along the entire lengths of edges 13–15, respectively, enable the tool to be easily grasped and lifted when it is lying flat on a supporting surface. Grooves 19–21 also improve the structural strength of housing 10, and reduce distortion during its molding process.

Figure 3:
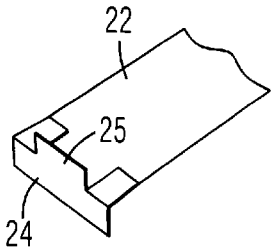
FIG. 3 is a top perspective view of a measuring tape of the tool.

A spring-loaded measuring tape 22 is rolled up inside housing 10, and is extendable for measuring distances. The free end of tape 22 is positioned within a notch 23 in corner 16, so that it does not protrude from corner 16. As shown in FIG. 3, the free end of tape 22 includes upper and lower hooks 24 and 25 extending from its top and bottom sides, so that it can be hooked onto the edge of a work piece, whether tape 22 is on top or under the work piece. A locking tab 26 is positioned in a slot 27 along edge 14, and is movable against tape 22 for locking it in any extended position. Locking tab 26 is completely recessed within edge 14 and does not protrude therefrom, so that edge 14 can be positioned flat against a work surface. Although the tip of locking tab 26 is slightly spaced inwardly from edge 14, as shown in FIG. 4, it may be flush with edge 14 instead.

A pair of guide rails 28 are attached along edge 13, so that edge 13 can be aligned perfectly with the edge of a work piece for drawing a perpendicular line with edge 14. A pencil holder 29 comprising a pair of opposing arms is attached to edge 15 for holding a pencil (not shown), which can be easily inserted and removed therefrom. A pencil sharpener 30 is also arranged along edge 15. Pencil shavings are emptied through a removable door 31 on a side of housing 10. A hole 32 extend between edges 13 and 15 adjacent corner 18. The tool can be used to draw a very large circle by inserting a nail (not shown) through hole 32 into a work piece, extending tape 22, positioning a pencil at the end of tape 22, and rotating tape 22 about the nail. A clip 33 is attached to a side of housing 10 for clipping the tool to the clothing of a user. Sides 11 and 12 include textured surfaces 34 on which erasable notes can be written with a pencil. A bubble level 35 is positioned within a window 36 for indicating the horizontal position. A resilient stop 37 is positioned along edge 13 adjacent corner 16 for cushioning tape 22 at the end of its retraction.

Figure 5:
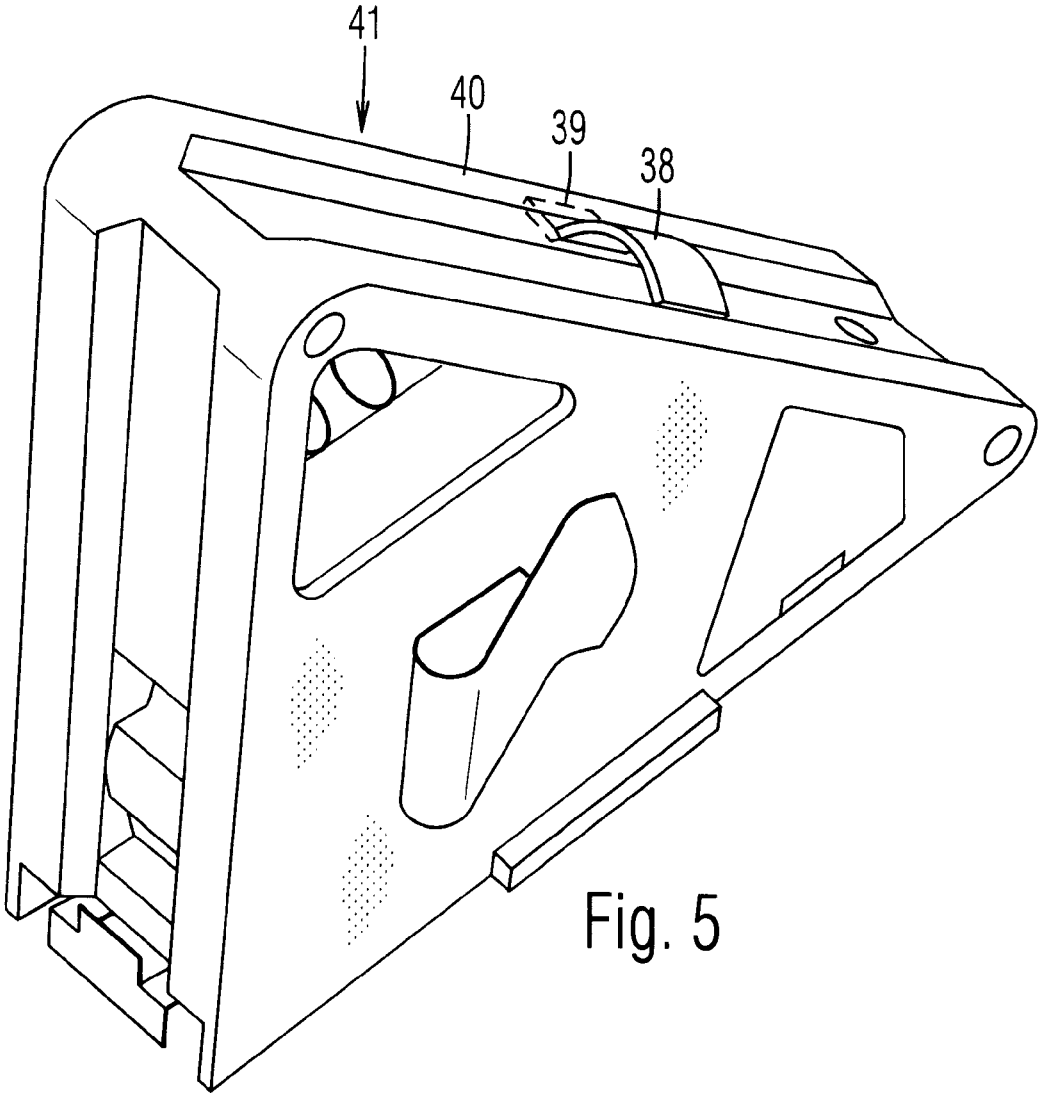
FIG. 5 is a top perspective view of a second embodiment of the square tool with tape measure.

A second embodiment of the square tool with tape measure is shown in the top perspective view in FIG. 5. It includes a pencil holder 38 comprising an outwardly bowed clip with a proximal end inserted into a slot 39 on edge 40 of a housing 41. Pencil holder 38 is generally parallel to the surface of edge 40.

Figure 6:
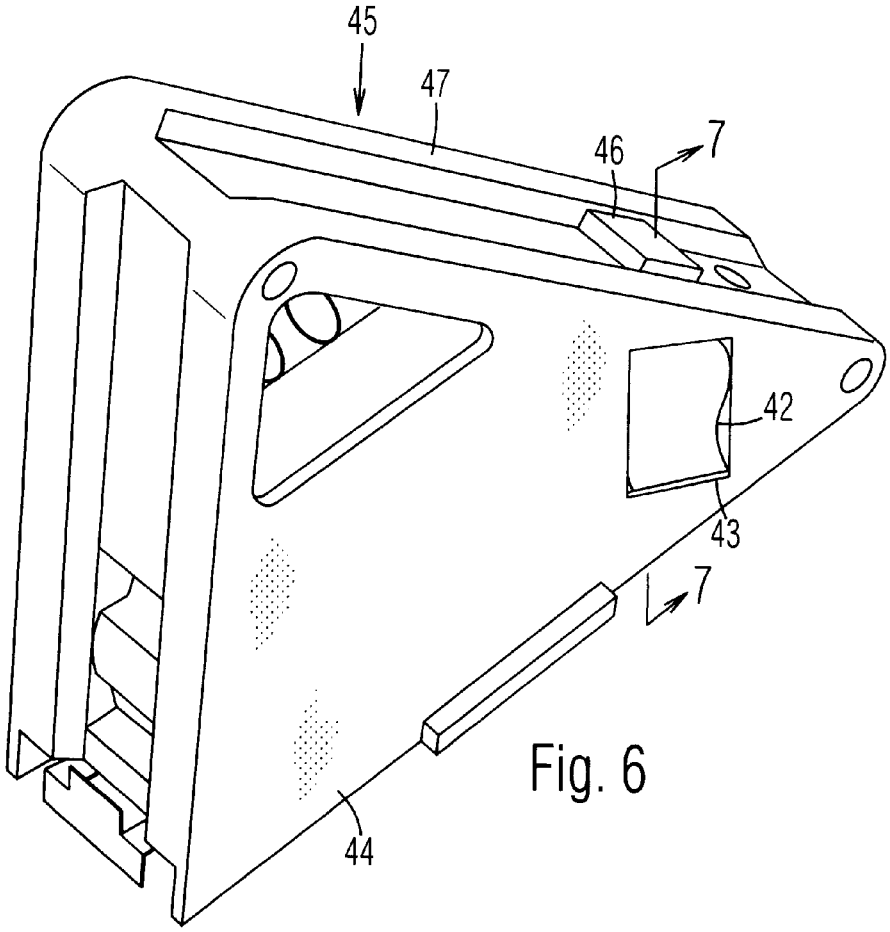
FIG. 6 is a top perspective view of a third embodiment of the square tool with tape measure.
Figure 7:
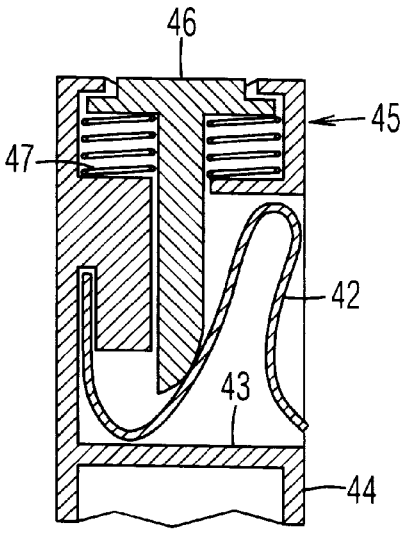
FIG. 7 is an end sectional view of a retractable belt clip in FIG. 6, taken along line 7—7 in FIG. 6, in a retracted position.
Figure 8:
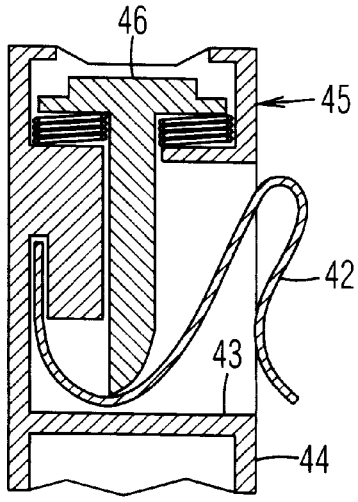
FIG. 8 is an end sectional view of the retractable belt clip of FIG. 7 in an extended position.

A third embodiment of the square tool with tape measure is shown in the top perspective view in FIG. 6 and the end sectional view in FIG. 7. It includes a retractable belt clip 42 which is normally fully retracted in a recess 43 on a side 44 of a housing 45, so that housing 45 can be laid flat on side 44 on a work surface. A button 46 includes an outer end positioned along an edge 47 of housing 45, and an inner end engaged against an intermediate portion of belt clip 42, which is preferably S-shaped. The inner end of belt clip 42 is anchored to housing 45. When button 46 is depressed against springs 47 positioned between it and housing 45, belt clip 42 is extended from recess 43, as shown in FIG. 8. When in an extended position, belt clip 42 is clipped onto the clothing of a user, and button 46 is released. When the tool is removed from the clothing, belt clip 42 is automatically retracted.

Figure 9:
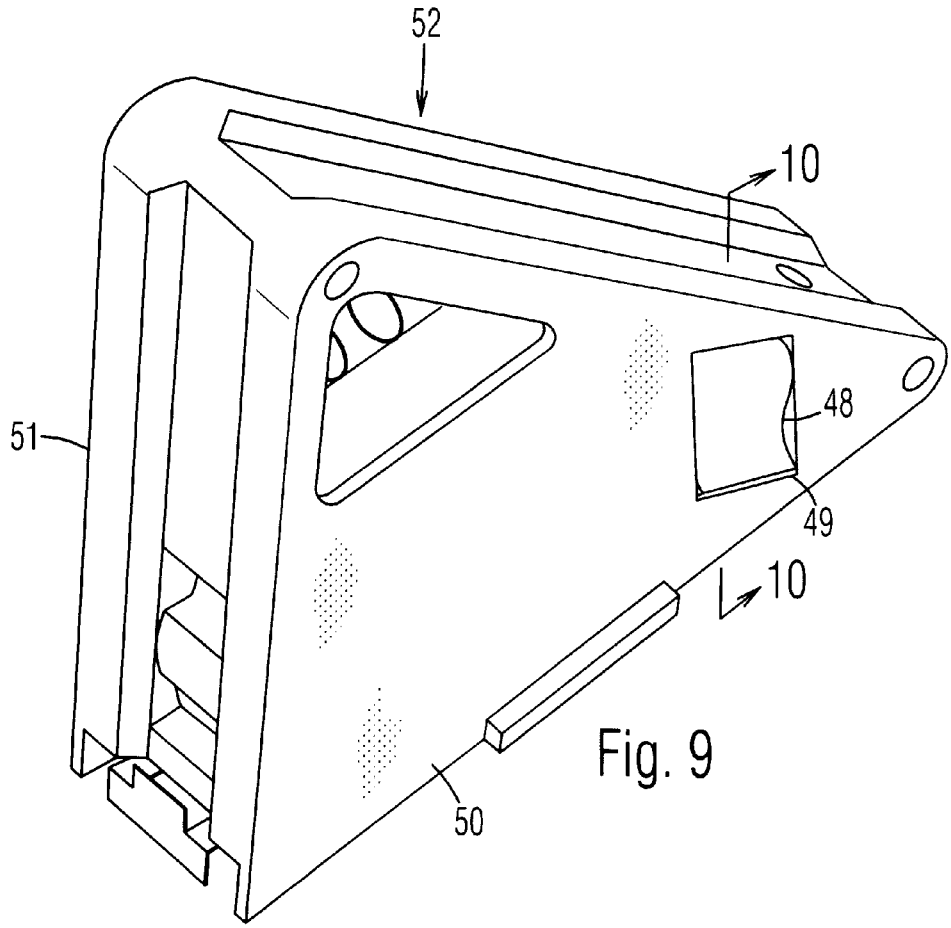
FIG. 9 is a top perspective view of a fourth embodiment of the square tool with tape measure.
Figure 10:
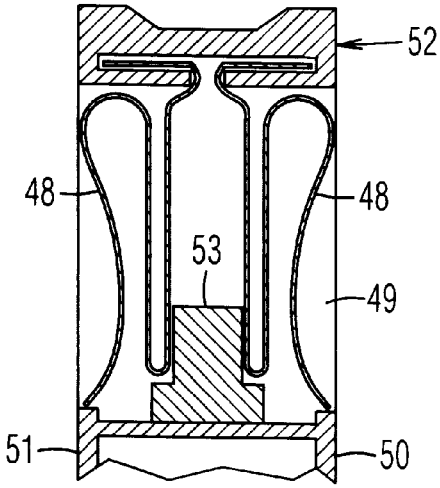
FIG. 10 is an end sectional view of a retractable belt clip in FIG. 9, taken along line 10—10 in FIG. 9, in a retracted position.
Figure 11:
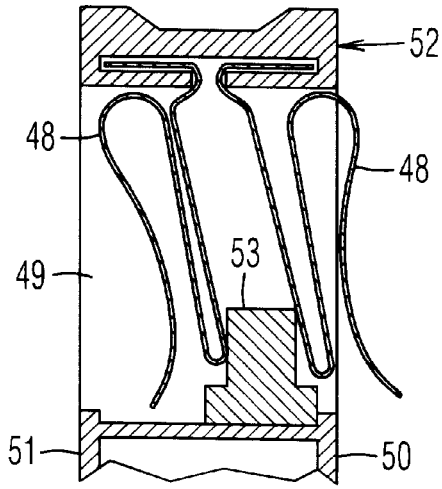
FIG. 11 is an end sectional view of the retractable belt clip of FIG. 10 in an extended position.

A fourth embodiment of the square tool with tape measure is shown in the top perspective view in FIG. 9 and the end sectional view in FIG. 10. It includes a pair of retractable belt clips or belt clip means 48 which are normally fully retracted in a channel 49 extending between opposite sides 50 and 51 of a housing 52, so that housing 52 can be laid flat on either side on a work surface. Each clip 48 is preferably S-shaped, and has an inner end anchored to housing 52. A sliding member 53 is positioned between clips 48 opposite their anchored ends. Either clip 48 may be extended by pushing the opposite clip inwardly, as shown in FIG. 11. The motion of the clip being pushed is transferred to the opposite clip by sliding member 53.

SUMMARY AND SCOPE

Accordingly, a square tool with tape measure is provided. It can be used for measuring a right-angle and at least one other angle, measuring distances, indicating the horizontal position, ensuring its alignment along at least one edge with a work piece, drawing a very large circle, holding a pencil which can be easily inserted and removed, sharpening the pencil, and receiving erasable written notes. It can be easily grasped and lifted when it is lying flat on a supporting surface. Its measuring tape can be locked in any extended position. It can be clipped onto the clothing of a user. It includes a retractable belt clip so that it can be laid flat on either side on a work surface. It has improved structural strength, and it resists distortion during its molding process.

Although the above description is specific, it should not be considered as a limitation on the scope of the invention, but only as an example of the preferred embodiment. Many substitutes and variations are possible within the teachings of the invention. For example, locking tab 26 can be positioned along any edge of housing 10. Locking tab 26 may be straight instead of curved, and movable linearly. Locking tab 26 may be positioned in a slot on a side of the housing instead of on an edge. Pencil holder 29, pencil sharpener 30, clip 33, and button 46 can be independently attached anywhere else on the housing. Hole 32 can be positioned through corner 17. Belt clips 48 may be integrally connected at their inner ends to form a single double-ended clip, one end of which may be extended by pushing against the other end. The housing may be of other shapes, such as rectangular, as long as it includes a right-angled corner. Therefore, the scope of the invention should be determined by the appended claims and their legal equivalents, not by the examples given.

I claim:

1. A tool for being clipped to a user's clothing, comprising:

a housing;

a recess arranged on a side of said housing; and a belt clip movably positioned within said recess generally without protruding from said side of said housing, said side of said housing for being positioned flat against a work piece when said belt clip is retracted within said housing, said belt clip being extendable from said recess for engaging said user's clothing;

wherein said belt clip is comprised of a S-shaped clip with an inner end anchored to an inner end of said recess, an outer end of said S-shaped clip being extendable from said recess by deforming an intermediate portion of said S-shaped clip in an outwardly direction.

2. A tool for being clipped to a user's clothing, comprising:

a housing;

a recess arranged on a side of said housing;

a belt clip movably positioned within said recess generally without protruding from said side of said housing, said side of said housing for being positioned flat against a work piece when said belt clip is retracted within said housing, said belt clip being extendable from said recess for engaging said user's clothing;

wherein said belt clip is comprised of a S-shaped clip with an inner end anchored to an inner end of said recess, an outer end of said S-shaped clip being extendable from said recess by deforming an intermediate portion of said S-shaped clip in an outwardly direction; and a button positioned against an inner side of said intermediate portion of said S-shaped clip, said outer end of said S-shaped clip being extended from said recess when said button is pushed against said intermediate portion of said S-shaped clip.

3. A tool for being clipped to a user's clothing, comprising:

a housing;

a channel extending between opposite sides of said housing; and a belt clip means movably positioned within said channel, said belt clip means having a pair of opposite clipping ends positioned adjacent corresponding opposite openings of said channel, either one of said clipping ends is extendable from a corresponding opening of said channel for engaging said user's clothing by pushing an opposite one of said clipping ends inwardly into said channel.

4. The tool of claim 3, wherein said belt clip means includes an inner portion anchored to an interior of said channel, said opposite clipping ends being extendable from said channel by flexing said belt clip means.

5. The tool of claim 3, wherein said belt clip means comprises a pair of separate belt clips each having an inner end anchored to an interior of said channel, one of said belt clips being extendable from a corresponding opening of said channel by pushing an opposite one of said belt clips inwardly into said channel.

* * * * *